US008083508B2

(12) United States Patent
Irving et al.

(10) Patent No.: US 8,083,508 B2
(45) Date of Patent: Dec. 27, 2011

(54) PROGRESSIVE CAVITY COMPRESSOR HAVING CHECK VALVES ON THE DISCHARGE ENDPLATE

(75) Inventors: Jack H. Irving, Los Angeles, CA (US); Florence L. Irving, legal representative, Los Angeles, CA (US); John M. Richardson, Los Angeles, CA (US); Betty J. Richardson, legal representative, Los Angeles, CA (US); Howard M. Robbins, Thousand Oaks, CA (US)

(73) Assignee: Blue Helix, LLC, Los Angeles, CA (US)

( * ) Notice: Subject to any disclaimer, the term of this patent is extended or adjusted under 35 U.S.C. 154(b) by 0 days.

(21) Appl. No.: 12/796,214

(22) Filed: Jun. 8, 2010

(65) Prior Publication Data

US 2011/0174010 A1 Jul. 21, 2011

Related U.S. Application Data

(60) Provisional application No. 61/295,345, filed on Jan. 15, 2010.

(51) Int. Cl.

| | |
|---|---|
| ***F01C 1/10*** | (2006.01) |
| ***F01C 5/00*** | (2006.01) |
| ***F03C 2/00*** | (2006.01) |
| ***F03C 4/00*** | (2006.01) |

(52) U.S. Cl. ..... 418/48; 418/15; 418/270

(58) Field of Classification Search ..... 418/9, 48, 418/189, 220, 270, 15; 417/356, 410.4, 420, 417/410.1

See application file for complete search history.

(56) References Cited

U.S. PATENT DOCUMENTS

| | | | | |
|---|---|---|---|---|
| 1,892,217 A | | 12/1932 | Moineau | |
| 2,085,115 A | | 6/1937 | Moineau | |
| 2,532,145 A | * | 11/1950 | Byram | 418/48 |
| 2,733,854 A | | 2/1956 | Chang | |
| 2,765,114 A | | 10/1956 | Chang | |
| 3,208,391 A | | 9/1965 | Lindberg | |

(Continued)

FOREIGN PATENT DOCUMENTS

| | | | | |
|---|---|---|---|---|
| GB | 1441219 A | * | 6/1976 | 418/48 |
| WO | WO 2006123927 A1 | * | 11/2006 | |

OTHER PUBLICATIONS

Kirill Alemaskin, K. Nandakumar, and Uttandaraman Sundararaj, "Progressive Thinking for Pumps", Fluent News, Fall 2006, p. 22.

(Continued)

*Primary Examiner* — Theresa Trieu

(74) *Attorney, Agent, or Firm* — Lowry Blixseth LLP; Stuart O. Lowry; Scott M. Lowry

(57) ABSTRACT

A new type of progressive cavity compressor is intended primarily for 3 to 10 ton vapor-cycle air conditioning systems. Major working section elements include a rotor, a stator, inlet ports, an outlet endplate, and outlet check valves. The helical rotor is driven in an eccentric orbital path inside the helical stator. In the preferred embodiment, the rotor and stator helices have varying (non-uniform) pitch in the working section. Rotor-stator running clearances are tight, to minimize leakage. Two outlet check valves regulate refrigerant discharge flow and pressure. Efficient compression is provided over a wide range of compression ratios, corresponding to a wide range of ambient temperatures in an air conditioning application. The invention can improve the energy efficiency of air conditioning systems, especially at off-design conditions.

17 Claims, 13 Drawing Sheets

U.S. PATENT DOCUMENTS

| | | | | |
|---|---|---|---|---|
| 3,275,226 | A * | 9/1966 | Whitfield | 418/189 |
| 3,380,391 | A | 4/1968 | John | |
| 3,938,915 | A * | 2/1976 | Olofsson | 418/48 |
| 4,802,827 | A | 2/1989 | Fujiwara et al. | |
| 6,361,292 | B1 | 3/2002 | Chang et al. | |
| 7,074,018 | B2 | 7/2006 | Chang | |
| 7,413,416 | B2 | 8/2008 | Bratu | |
| 7,530,217 | B2 | 5/2009 | Murrow et al. | |
| 7,624,565 | B2 | 12/2009 | Murrow et al. | |
| 7,726,115 | B2 | 6/2010 | Murrow et al. | |

OTHER PUBLICATIONS

Jose Gamboa, Aurelio Olivet, Juan Iglesias and Pedro Gonzalez, "Understanding the Performance of a Progressive Cavity Pump with a Metallic Stator", Proceedings of the Twentieth International Pump Users Symposium, 2003, pp. 19-31.

Aurelio Olivet, Jose Gamboa, and Frank Kenyery, "Experimental Study of Two-Phase Pumping in a Progressive Cavity Pump Metal to Metal", Society of Petroleum Engineers No. 77730 (SPE 77730), 2002, pp. 1-10.

Emilio E. Paladino, Joao A. Lima, Rairam F. C. Almeida and Benno W. Assmann, "Computational Modeling of the Three-Dimensional Flow in a Metallic Stator Progressing Cavity Pump", Society of Petroleum Engineers No. 114110 (SPE 114110), 2008m, pp. 1-9.

Alan G. Wild, "Progressing Cavity Pumps Proper Selection and Application", Proceedings of the Ninth International Pump Users Symposium, 1992, pp. 111-116.

Igor J. Karassik, Joseph P. Messina, Paul Cooper and Charles C. Heald, "Pump Handbook", 3rd Ed., New York: McGraw-Hill, 2001, pp. 3.99-3.100.

Aurelio Olivet, Jose Gamboa, and Frank Kenyery, "Experimental Study of Two-Phase Pumping in a Progressive Cavity Pump Metal to Metal", Society of Petroleum Engineers No. 77730.

* cited by examiner

PROGRESSIVE CAVITY COMPRESSOR HAVING CHECK VALVES ON THE DISCHARGE ENDPLATE

BACKGROUND OF THE INVENTION

This invention relates generally to improvements in a compressor of the type used primarily for air conditioning applications. More specifically, this invention relates to an improved compressor, preferably of the progressive cavity type, designed for improved efficiency particularly at part load operating conditions.

Rene Moineau did his Ph.D. research and thesis on the progressive cavity pumping principle. (Devices employing Moineau's geometry are known, variously, as "Moineau", "progressive cavity", or "progressing cavity" devices). The first of his ten or more U.S. patents, U.S. Pat. No. 1,892,217, was issued in 1932. This patent mentions varying-pitch and is intended to include applicability to compressible fluids. To date, progressive cavity pumps have been used mainly to pump viscous liquids, such as petroleum, or to handle liquids containing solid material, such as drilling fluids.

A few progressive cavity compressor patents have been issued, e.g., Fujiwara, U.S. Pat. No. 4,802,827. In addition, several progressive cavity pump patents describe or claim applicability to compressible fluids, including liquid-gas mixtures. For one example, see Varadan, U.S. Pat. No. 6,093,004.

To date the progressive cavity principle has seen little or no use in any compressor application. In vapor-cycle systems of 3 to 10 ton capacity, the scroll compressor and the piston compressor are dominant. Both types are mass-produced at relatively low cost, but generally have not included features that promote good off-design energy efficiency.

The present invention is aimed to compete against the well established piston and scroll compressors in air conditioning applications, by means of superior energy efficiency, especially at part load conditions on cooler days. The invention can also be usefully applied to other compressor applications for which the required compression ratio varies, and for which off-design energy efficiency is important.

Some vapor-cycle compressors used for air conditioning are designed for a fixed compression ratio that matches a maximum outside ambient air temperature. The compressor is run in an inefficient off-design mode on days when the ambient temperature is below this maximum. To promote off-design energy efficiency, the present invention operates efficiently over a range of compression ratios, corresponding to a range of outside ambient air temperatures.

The U.S. Department of Energy (DOE) has issued regulations calling for improvement of the energy efficiency of vapor-cycle air conditioning and refrigeration systems. In promulgating these regulations, DOE has established "SEER" (Seasonal Energy Efficiency Ratio) ratings which promote off-design energy efficiency, including efficient operation at various outside ambient air temperatures. The present invention responds to these SEER regulations.

Moineau Configuration in General

A fairly complex mathematical theory defines a family of rotor and stator shapes that result in the formation and progression of sealed cavities through a Moineau pump or compressor. In this family, the rotor and stator both have lobes, and the number of stator lobes is always one greater than the number of rotor lobes. The simplest possible case is one rotor lobe and two stator lobes. In this simplest case each rotor cross section is circular (diameter $D_r$), and each stator cross section consists of two semicircles (of diameter $D_s$), separated by a rectangle of dimension $D_s \times H$ as shown in FIG. 2. $D_s$ equals $D_r$ plus $2\delta$, where $\delta$ is the small clearance between the rotor and the stator. For a more complex configuration having more than two stator lobes, each stator cross section is defined by a number of semicircles arranged symmetrically about the stator axis and corresponding in number with the number of stator lobes, and separated by a more complex geometric figure.

A Moineau rotor has two motions relative to the stator: a "planetary" rotation about the symmetry axis of the stator, and a "spin" rotation about its own axis. These rotations are in opposite directions. The symmetry axis of the stator and the rotation axis of the rotor are parallel to each other, and are separated by a constant distance, which is the design parameter known as axes separation, or SEP. This separation is enforced by a pair of crank arms or something similar, outside the fluid region, which rotate around the symmetry axis of the stator, and support the two ends of the eccentrically mounted rotor.

Moineau Pumps

No valves are needed in a Moineau pump because the pumped fluid is incompressible. The standard Moineau pump has no special requirements as to outlet-end geometry. While fluid is being expelled from a cavity that is open to the pump discharge, the pressure in the cavity will automatically assume the discharge pressure downstream of the pump, plus the small pressure drop through the discharge port(s).

Valveless Varying-Pitch Moineau Compressor

One pre-existing concept is to create a progressive cavity compressor by altering a progressive cavity pump so that the volume of each cavity decreases as the cavity moves through the working section of the machine. This can be done in any of several ways, for example by means of a rotor and stator that are (a) varying-pitch; (b) cone-shaped; or (c) made up of parallel curves—all as discussed in more detail herein. The net result is a volumetric compression ratio determined by the geometry, and a corresponding pressure ratio determined (ideally) by the compression ratio and the gas laws for the working fluid. This type of compressor can operate efficiently without valves if its main use is at or near the inlet and outlet pressures for which it was designed. At off-design conditions, there will be a pressure mismatch between the outlet plenum and a cavity about to be vented. The result, in the valveless compressor, is a loss of efficiency from the sudden inflow or outflow of the working gas to or from a newly vented cavity.

SUMMARY OF THE INVENTION

As shown in the accompanying drawings, an improved compressor is intended primarily for 3 to 10 ton vapor-cycle air conditioning systems. Major working section elements comprise a rotor, a stator, inlet ports, an outlet endplate, and outlet check valves. A helical-shaped rotor is driven in an eccentric orbital path inside a helical-shaped stator. In the preferred embodiment, the rotor and stator helices have varying (non-uniform) pitch in at least a portion of the working section. Rotor-stator running clearances are tight, to minimize leakage. Two or more outlet check valves regulate refrigerant discharge flow and pressure through the outlet endplate to a discharge plenum chamber. Efficient compression is provided over a wide range of compression ratios, corresponding to a wide range of ambient temperatures in an air conditioning application. The invention can improve the energy efficiency of air conditioning systems, especially at off-design conditions.

More particularly, in one preferred form of the invention, the rotor and stator helices have a varying or non-uniform pitch which reduces progressively from an inlet or intake end to the outlet endplate. Accordingly, a compressible fluid such as a refrigerant of the type used commonly in a modern air conditioning system is drawn through the inlet ports and progressively compressed upon travel through the rotor-stator working section in a direction toward the outlet endplate, as the decrease in pitch corresponds with decreased compressor chamber volume in a direction toward the outlet endplate.

In an air conditioning application, the compression ratio $CR_1$ matches that required on a relatively cool day, when a moderate outside ambient temperature results in a moderate required compressor discharge pressure. In this situation, all or nearly all the gas compression takes place in the compressor cavities. The compressed gas is pushed out the exit end of the chamber, through the outlet check valves, at essentially constant pressure.

On a hot day, further compression is required beyond that provided in the working section through volume reduction of the closed cavities. This further compression to $CR_2$ is done at the outlet end of the compressor by reduction of cavity volume against the fixed outlet endplate. The outlet check valves prevent backflow into a compressor cavity from the outlet plenum chamber, but open to allow a forward flow when there is a pressure differential between the compressor cavity and the outlet plenum chamber, that is, when the cavity pressure slightly exceeds the outlet plenum pressure. As a result, the compressor automatically adapts to a range of outside ambient temperatures, delivering the required pressure with little or no wasted compression energy.

Other features and advantages of the present invention will become apparent from the following detailed description, and from the accompanying drawings, which illustrate, by way of example, the principles of the invention.

BRIEF DESCRIPTION OF THE DRAWINGS

The accompanying drawings illustrate the invention. In such drawings:

FIG. 11 is a longitudinal cross-sectional view of a fixed-pitch ("baseline") compressor, wherein FIGS. 1-2 and 5-9 are applicable to both the varying-pitch and fixed-pitch embodiments of the invention;

DETAILED DESCRIPTION OF THE PREFERRED EMBODIMENTS

Figure 1:
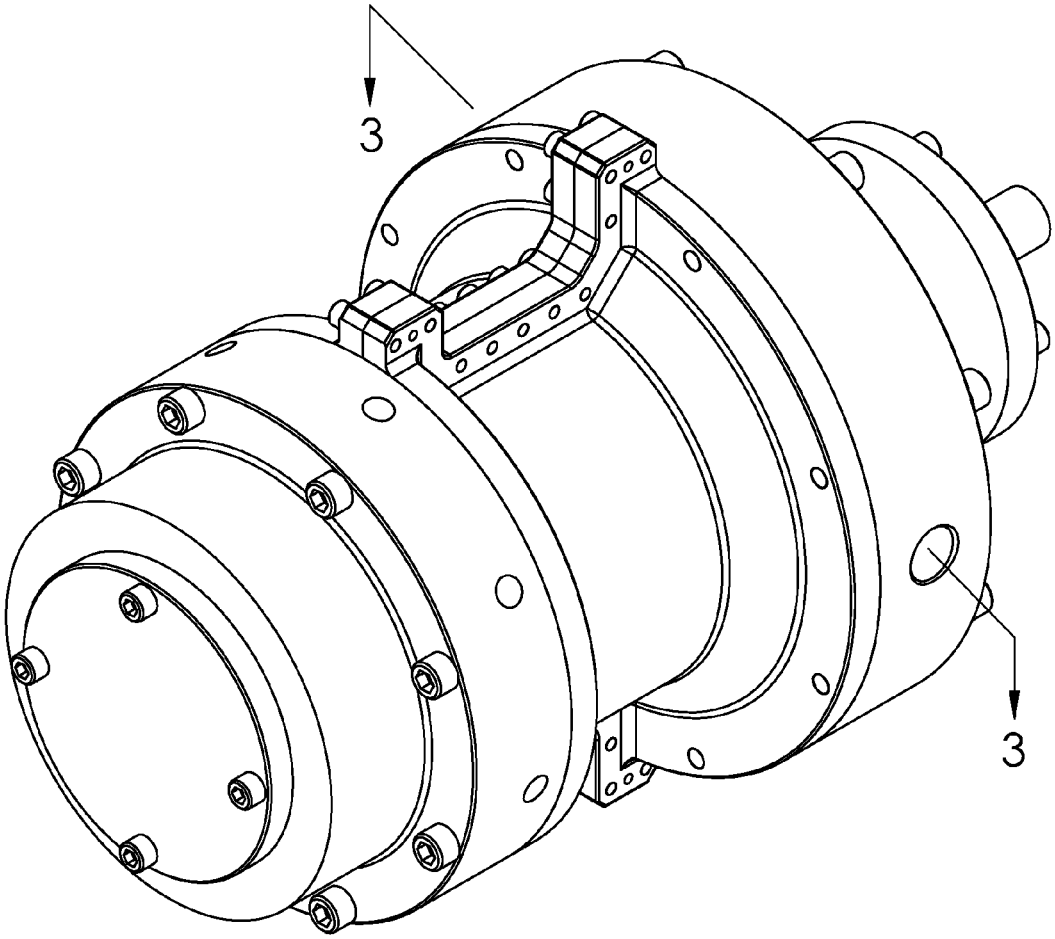
FIG. 1 shows an illustrative compressor exterior in an isometric view.

Following are the numbered parts of the varying-pitch ("preferred embodiment") compressor, as shown in the accompanying drawings:

12 rotor
13 rotor shaft
14 stator
15 crankshaft
16 inlet housing
18 outlet endplate
20 planetary gear
22 ring gear
30 inlet ports
32 inlet plenum
34 inlet cavity
36 mid-section cavity
38 outlet cavity
40 outlet ports
42 check valves
44 endplate hole
46 outlet plenum
48 main outlet port
50 crankshaft center
52 rotor shaft center
53 electric drive motor
61 crankshaft bearings
62 crankshaft cup
63 cup bearings
64 rotor extension shaft
110 air conditioning condenser
111 outside fan
112 compressor
113 room air fan
114 expansion device
115 evaporator
116 outside unit The preferred embodiment of the present invention, a varying-pitch progressive cavity compressor with valves, will be described in detail here.

The preferred embodiment shares some characteristics with previous progressive cavity pump patents:

(1) Single-lobe rotor with a circular cross section;
(2) Two-lobe stationary stator cross section with semi-circular ends;
(3) Helical rotor and stator, with the rotor pitch half the stator pitch at any cross section; and (4) Rotor driven in an orbit around the stator center, with the orbital motion enforced by a crank or similar mechanism.

The present invention combines the above-listed elements with (i) a varying-pitch rotor and stator, and (ii) outlet check valves to create a novel compressor which operates efficiently at both design-point and off-design-point conditions.

The rotor and stator have a decreasing pitch in the direction of gas flow throughout the working section. This decrease in pitch leads to a decrease in the volume of closed progressive cavities from an initial value $V_1$ to a reduced volume $V_2$ as the cavities carry the gas through the working section. The gas is compressed as the result of the decrease in cavity volume. This decrease in cavity volume is designed to achieve a compression ratio $CR_1=V_1/V_2$ that is less than the design maximum compression ratio specified for the compressor, $CR_2$.

In a variant of the above-described pitch distribution, the pitch can be fixed in the first part of working section and becomes varying—and strictly decreasing—part way through the working section. This variant pitch distribution is useful and within the scope of the invention, but the strictly decreasing pitch distribution throughout the entire working section is preferred. Other variants of pitch configuration are possible.

In an air conditioning application, the compression ratio $CR_1$ matches that required on a relatively cool day, when a moderate outside ambient temperature results in a moderate required compressor discharge pressure. In this situation, all or nearly all the gas compression takes place in the cavities. The compressed gas is pushed out the exit end of the chamber, through outlet check valves, at essentially constant pressure.

On a hot day, further compression is required beyond that provided in the working section through volume reduction of the closed cavities. This further compression to $CR_2$ is done at the outlet end of the compressor by reduction of cavity volume against a fixed endplate. The outlet check valves prevent backflow into a compressor cavity from the outlet plenum chamber, but allow a forward flow when the cavity pressure equals or slightly exceeds the outlet pressure. As a result, the compressor automatically adapts to a range of outside ambient temperatures, delivering the required pressure with no wasted compression energy.

Figure 3:
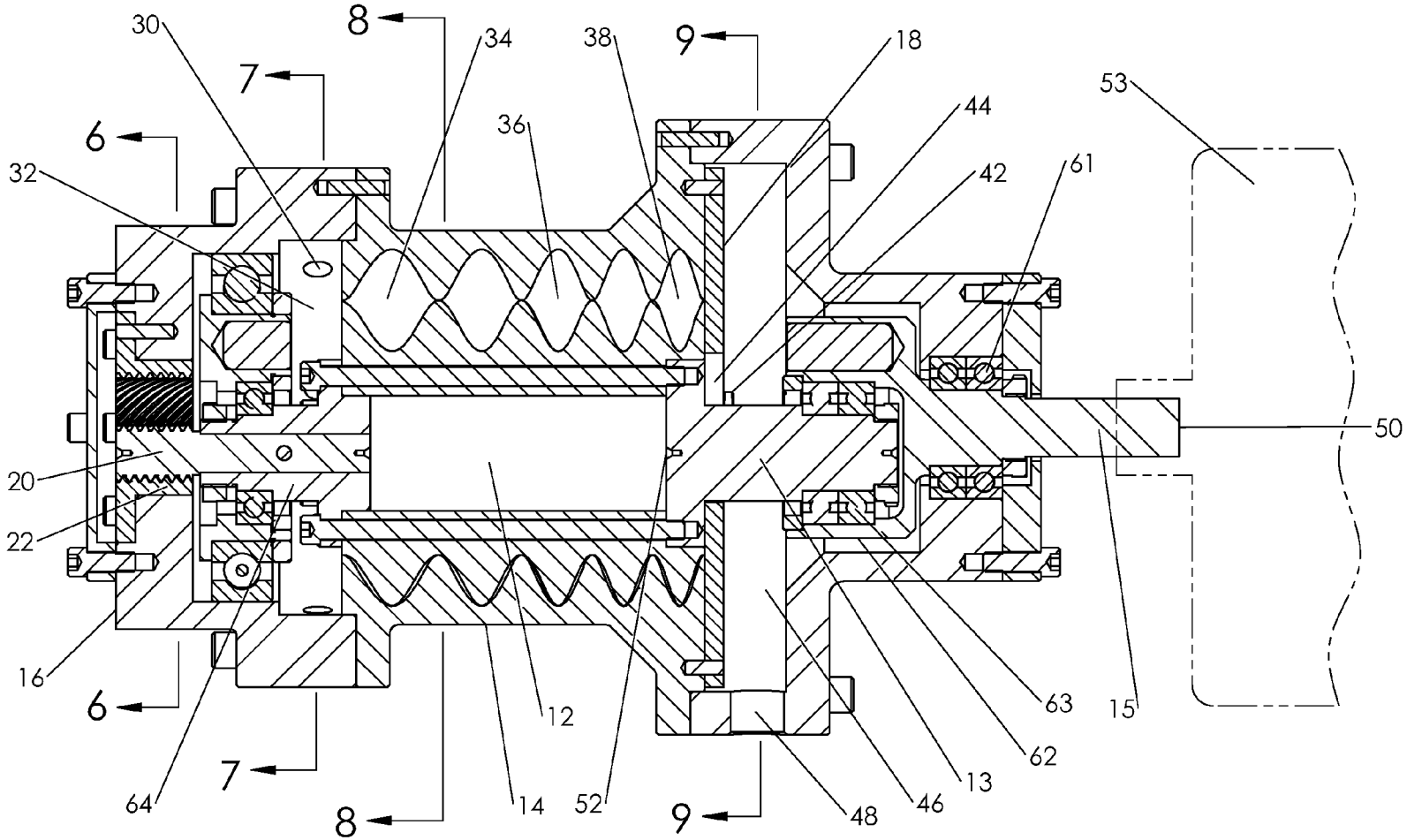
FIG. 3 is a longitudinal cross-sectional view of a progressively varying-pitch compressor constructed in accordance with the present invention.
Figure 4:
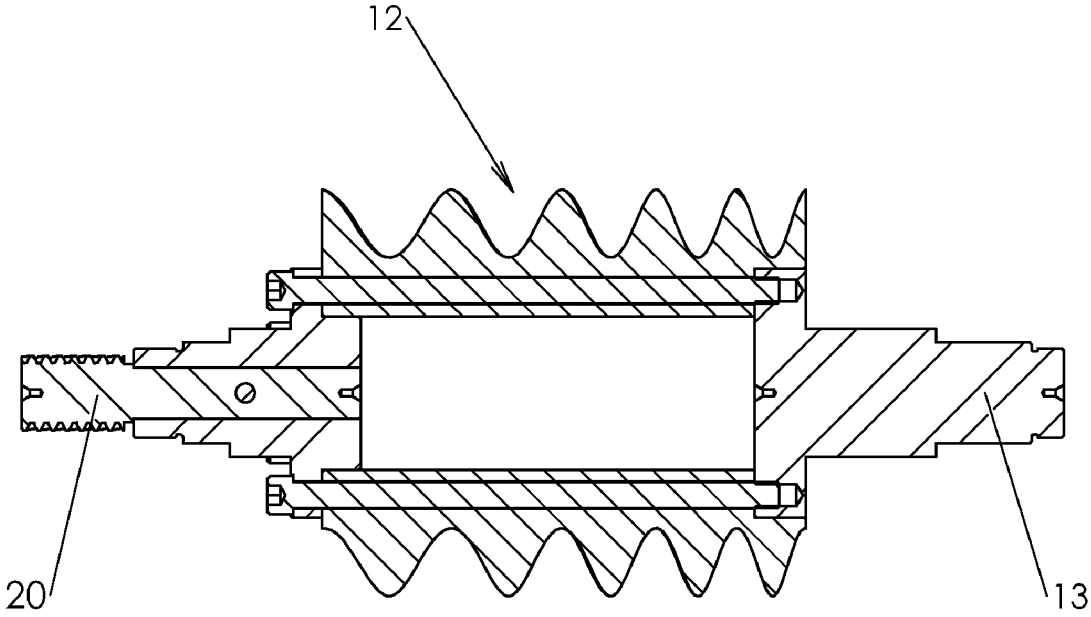
FIG. 4 is a longitudinal cross-sectional view of a varying-pitch rotor with its shaft and planetary gear, for use in the varying-pitch compressor of FIG. 3.
Figure 5:
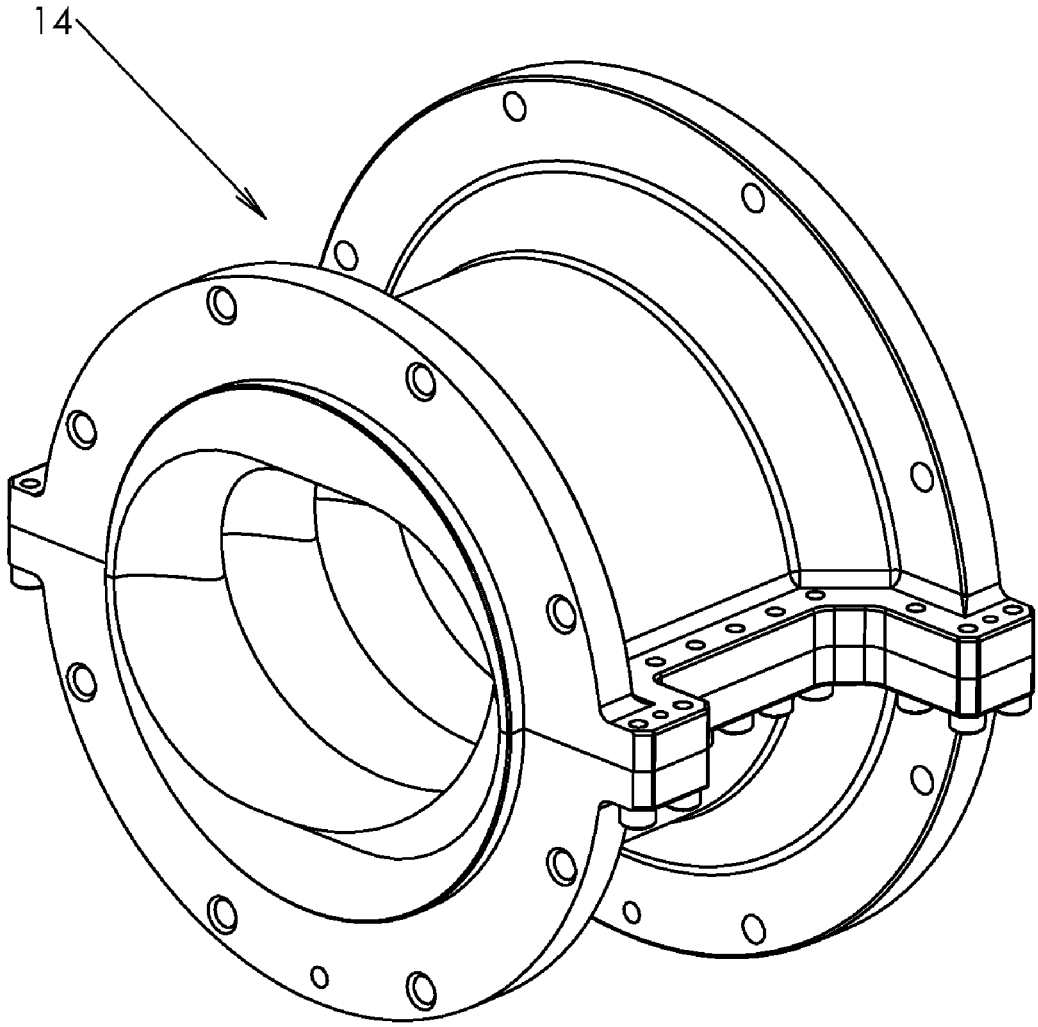
FIG. 5 is an isometric view of a varying-pitch stator, for use in the varying-pitch compressor of FIG. 3.

FIG. 3 is a longitudinal cross-sectional drawing of the preferred embodiment of the present invention. It contains a rotor 12 and a stator 14, each of helical shape. The rotor 12 fits inside the stator 14. Any radial cross section of the rotor 12 is a circle and any stator 14 cross section consists of two semicircles separated by a rectangle. The rotor 12 and the stator 14 are of equal length. Attached to the stator 14 are an inlet housing 16 and an outlet endplate 18.

Figure 7:
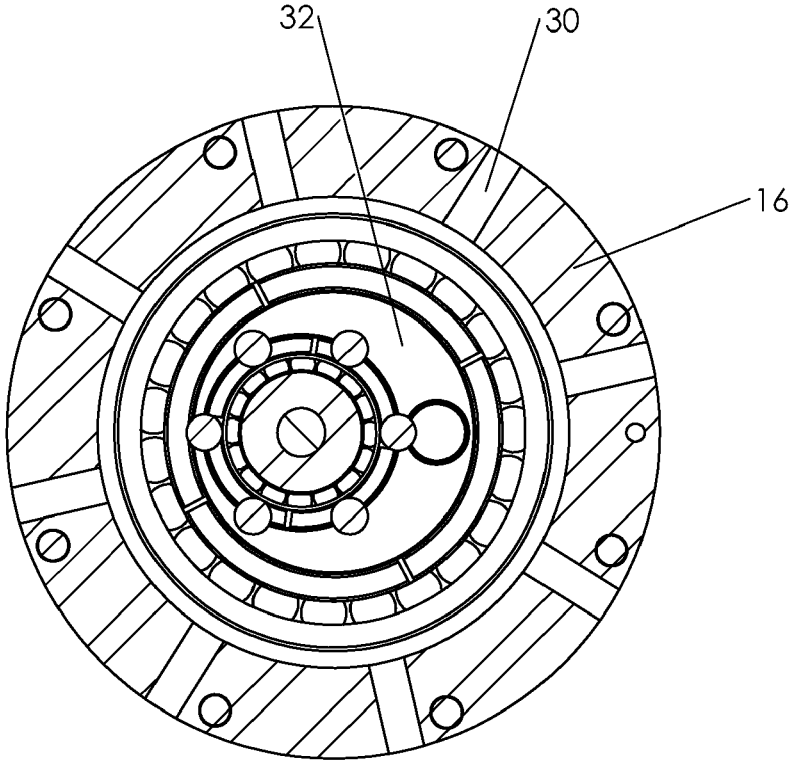
FIG. 7 is a cross-sectional view of a portion of an inlet plenum chamber, showing inlet or intake ports.
Figure 9:
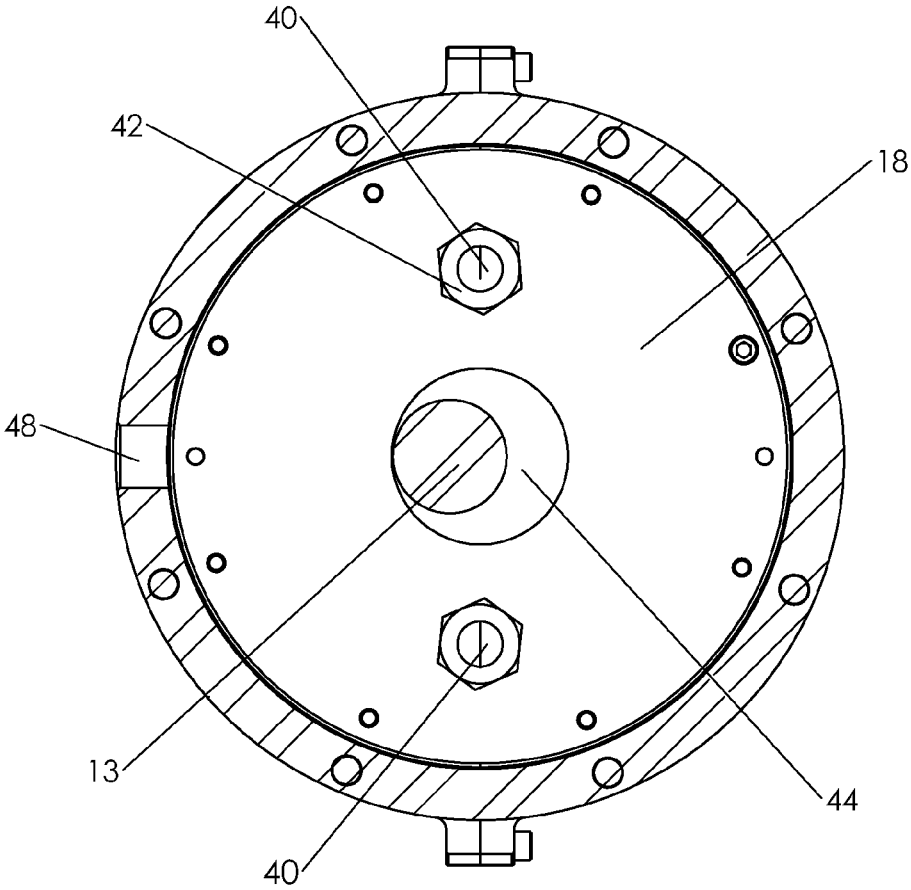
FIG. 9 is a cross-sectional view showing an outlet plenum chamber and a pair of outlet ports of the varying-pitch compressor.

As indicated in FIG. 7, the inlet housing 16 has eight inlet ports 30 shown in the preferred form. FIG. 9 shows the outlet endplate 18 with two outlet ports 40 fitted with check valves 42. As shown in FIGS. 3 and 9, the main elements of the compressor flow path are the rotor 12, the stator 14, the inlet ports 30, the outlet ports 40, and the two outlet check valves 42.

Figure 6:
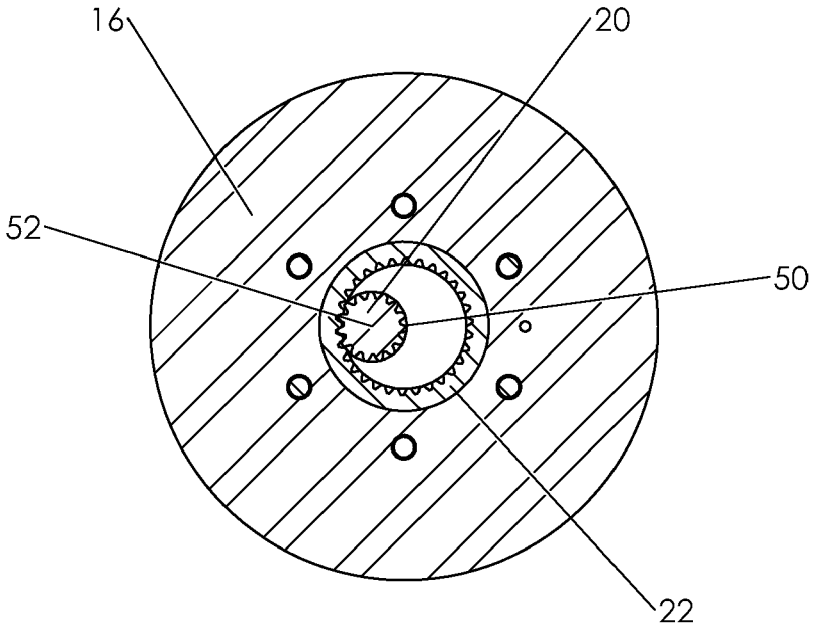
FIG. 6 is a cross-sectional view showing an inlet housing and the planetary gear set of the varying-pitch compressor of FIG. 3.

One can visualize the rotor 12 as if it were formed out of a series of thin circular discs, with each disc displaced slightly counterclockwise relative to the disc immediately upstream ("counterclockwise" displacement is reckoned by looking downstream from the inlet). The displacement is applied to each circular cross section of the rotor 12 about the crankshaft center 50 (shown in FIG. 6). For each rotor 12 cross section, the distance between the crankshaft center 50 and the rotor shaft center 52 is a constant, equal to the previously mentioned axes separation, SEP.

Figure 2:
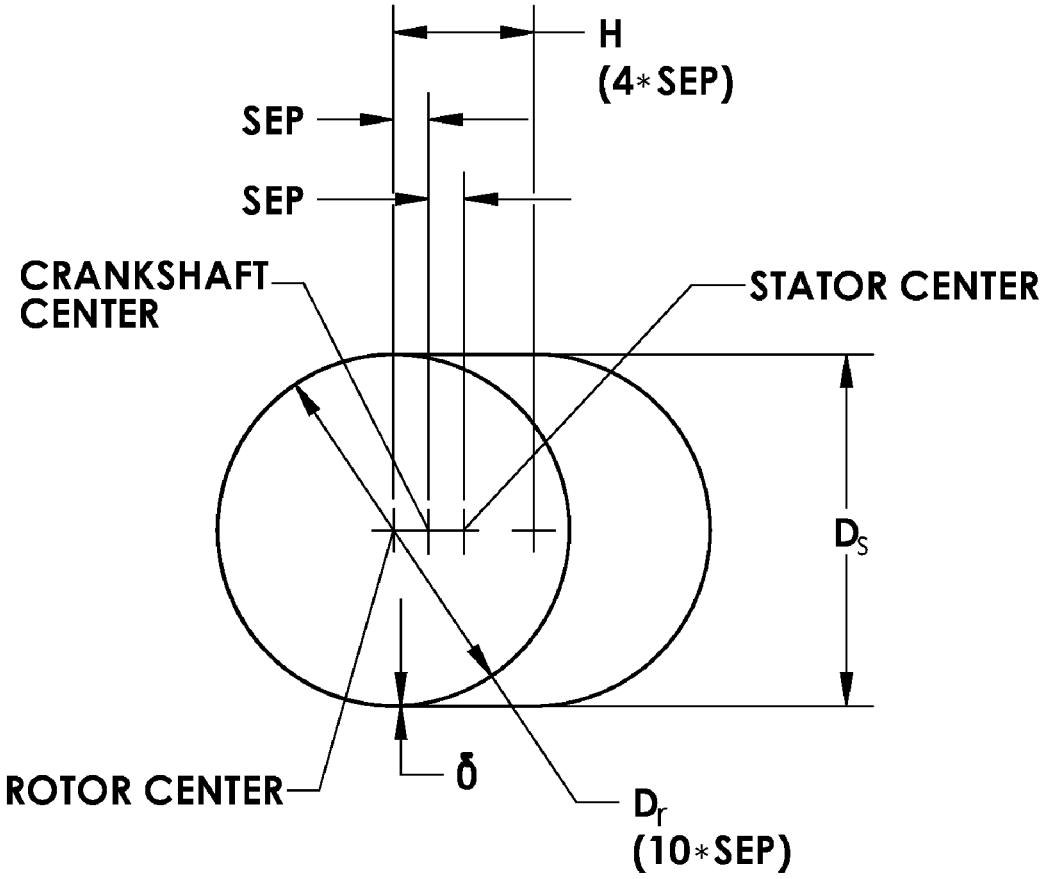
FIG. 2 is a simplified cross-sectional configuration of a Moineau-type pump or compressor.

The interior cross section of the stator 14 has a uniform size and shape at all axial positions within the working section. In a simplified geometry having a pair of stator lobes, the interior cross section of the stator 14 is formed by two semi-circular ends, of diameter $D_s$ separated by a rectangle of dimensions $D_s \times H$, as shown in FIG. 2. Stator 14 and rotor 12 radii are related by $R_s=R_r+\delta$, where $R_r$ is the radius of the rotor 12, and $\delta$ is a clearance dimension which must be kept small, on the order of 0.075 mm or less, in order to minimize internal leakage of the working gas. The stator interior dimension H is equal to four times the separation of rotor axes (H=4*SEP).

The pitch for a fixed-pitch rotor or stator is measured by the axial distance between two lobes that are separated by a 360 degree twist. The pitch for a varying-pitch rotor or stator is defined locally, by the derivative $dZ/d\theta$, where dZ is a small axial distance over which a small change in twist angle $d\theta$ occurs.

Varying (non-uniform) pitch therefore means that the derivative $dZ/d\theta$ has to change from point to point along the working section for both the rotor and the stator. Embodiments of this invention discussed here have a one-lobe rotor and a two-lobe stator, for which the stator pitch has to be twice the rotor pitch, whether the pitch is fixed or varying. So for varying-pitch sections, this 2:1 ratio has to be maintained locally. Thus the local $dZ/d\theta$ for the stator has to be twice the local $dZ/d\theta$ for the rotor at any given Z value along the varying-pitch working section.

As indicated in FIG. 3, when the compressor is running, the orbital rotor motion forms a succession of cavities 34, 36, and 38 between the rotor 12 and the stator 14. The cavities progress from inlet to outlet through three different regions, A, B and C of the working section:

Region A: inlet cavity 34 region (adjacent to the inlet ports 30);

Region B: mid-section cavity 36 region (through the center of the working section); and Region C: outlet cavity 38 region (adjacent to the outlet ports 40 shown in FIG. 9).

The regions A, B, and C of the working section will now be described in more detail.

Region A: As indicated in FIG. 3, each newly formed cavity is in contact with the eight inlet or intake ports 30, which are circular holes in the inlet housing 16. While a cavity is in communication with the inlet ports 30, the cavity increases in volume, so that refrigerant is drawn through the inlet ports 30 into the cavity. The gas pressure in the cavity is essentially constant and equal to the compressor inlet pressure if the small pressure drop through the inlet ports 30 is neglected. After one rotor 12 revolution, the cavity becomes closed off from the inlet, ending the open-to-intake portion of the cavity movement. Since the stator 14 has two lobes, two such capture events (a half-cycle apart) occur for every rotor 12 revolution, forming two sets of closed cavities.

Region B: As indicated in FIG. 3, after an inlet cavity 34 has become closed off from the inlet ports 30, it moves axially as a mid-section cavity 36 through the closed part of the working section. If this closed part were fixed-pitch, the mid-section cavity would have a constant volume, and there would be no compression in the cavity. In the preferred embodiment, with a varying-pitch working section, the pitch decreases in the direction of flow. The mid-section cavity 36 volume therefore decreases, and the fluid such as a compressible gas (refrigerant) is thereby compressed to the previously mentioned compression ratio $CR_1=V_1/V_2$. $V_1$ is the volume of a cavity just after the cavity is closed off from the inlet. $V_2$ is the cavity volume just before it comes in contact with the outlet endplate 18, containing the outlet ports 40 and check valves 42 as shown in FIG. 9. As previously described, $CR_1$ is the compression ratio required for air conditioning on a relatively cool day. The compressor efficiently provides gas at a compression ratio as low as $CR_1$.

Figure 8:
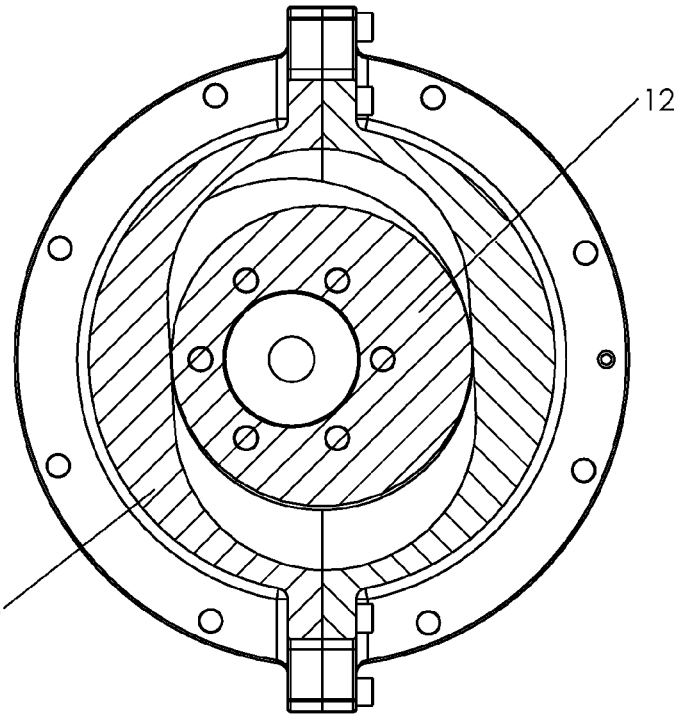
FIG. 8 is a cross-sectional view showing a portion of the rotor-stator working section of the varying-pitch compressor.

Region C: As each outlet cavity 38 reaches the outlet end of the compressor, the cavity comes in contact with the outlet endplate 18, which contains two identical outlet ports 40, corresponding to the two lobes of the stator 14 as shown in FIGS. 3, 8 and 9. As indicated in FIG. 3 and FIG. 9, the outlet ports 40 are fitted with check valves 42 that prevent backflow of refrigerant through an outlet port 40 into its connected outlet cavity 38. The check valves 42 are provided in a number corresponding with the number of stator lobes, and are arranged symmetrically on the endplate 18 about the stator axis (FIG. 9 shows a pair of check valves 42 at diametrically opposed positions). Without the check valves 42, this backflow would take place whenever the outlet cavity pressure is less than the pressure downstream of the compressor. In the outlet cavity portion of the working section, the rotor 12 motion causes the outlet cavity volume to decrease almost to zero. As a result, the refrigerant in the outlet cavity 38 is compressed to match the outlet pressure, and is expelled from the compressor working section through one of the outlet ports 40 to an outlet plenum chamber 46 (FIG. 3). The decreasing pitch in the outlet cavity region of the working section augments the compression process during gas expulsion, by reducing the outlet cavity 38 volume below what it would be if the pitch were fixed. As a result, the pressure in the outlet cavity 38 rises to equal or slightly exceed the downstream pressure earlier in the rotation cycle than it would if the pitch in this section were fixed; and the check valves 42, responding to a differential between the pressure in the outlet cavity 38 and the pressure in the outlet plenum chamber 46, have more open time. Therefore the pressure drop through the check valves 42 is reduced for a given valve size.

Advantages at Part Load

At the low end of the range of ambient temperatures and corresponding compression ratios for which the compressor is designed, the outlet check valves 42 can remain open all the time. In all other cases, each outlet check valve opens and closes once per revolution of the rotor 12. Once per half-cycle, a cavity 38 arrives at the endplate 18, and the corresponding check valve closes to prevent backflow. It remains closed until the cavity pressure exceeds the pressure of the outlet plenum. Then it opens to allow an outward flow.

For moderate ambient temperatures (which is the most frequent case), only a small amount of extra compression is required, so the check-valves will be open most of the time, and will sometimes be open simultaneously. For higher (and less frequent) ambient temperatures (and correspondingly higher outlet pressures), the valve-openings are delayed, so less time is available for expelling gas through the exit port, and flow velocities will be higher.

If the working section had constant pitch, there would be no internal compression; all the required compression would have to be achieved by compression against the endplate 18. Therefore, the outlet check valves 42 would open later, requiring higher flow velocities in all cases—including the frequent cases with moderate ambient temperatures.

Another advantage of doing some of the compression internally is that it reduces the pressure difference that causes backflow. This is especially important in the frequent case of moderate ambient temperatures.

Flow Path

The flow path of refrigerant gas through the varying-pitch compressor can be visualized by reference to the longitudinal cross section FIG. 3. Gas flows into the working section of the compressor from a large intake or inflow plenum (not shown) that surrounds the entire compressor and its electric drive motor 53.

The gas flows into the compressor working section, through eight inlet ports 30 in the inlet housing 16, into the inlet plenum 32.

The gas then flows from the inlet plenum 32 into the inlet cavities 34. As long as a cavity is open to one or more of the inlet ports 30, the cavity pressure will be essentially equal to the compressor inlet pressure.

The gas flow through the compressor mid-section cavities 36 has been described above.

Gas flows out of the compressor working section outlet cavities 38 through two outlet check valves 42 that are mounted in outlet ports 40 in an outlet endplate 18. The function of the check valves 42 has been described above. Gas flows through the check valves 42 into the outlet plenum 46. Each check valve 42 opens to allow gas flow whenever the pressure in the adjacent outlet cavity 38 becomes slightly greater than the pressure in the outlet plenum 46. A main outlet port 48 is mounted on the outlet plenum 46. Suitable plumbing (not shown) runs through the previously mentioned large plenum (not shown) to carry the compressed gas from the outlet port 48 to an external compressor outlet.

As indicated in FIG. 9, the rotor shaft 13 passes through an endplate hole 44 in the outlet endplate 18. The endplate hole 44 must be large enough to allow for orbital motion of the rotor shaft 13, as discussed herein in more detail.

Endplate hole 44 (less the part occupied by the rotor shaft 13) would provide a leakage path between the outlet plenum chamber 46 and the adjacent outlet cavities 38, unless sealed. A seal is necessary because the pressure in the outlet plenum chamber 46 is substantially constant, while the pressure in the outlet cavities 38 varies periodically over a compressor rotation cycle. The necessary seal is provided by maintaining a close running clearance between the end of the rotor 12 and the outlet endplate 18.

This is one of several points in the compressor working section where leakage must be minimized by maintaining a close running clearance between moving and stationary parts.

Rotor Mounting and Drive Mechanism

Figure 10:
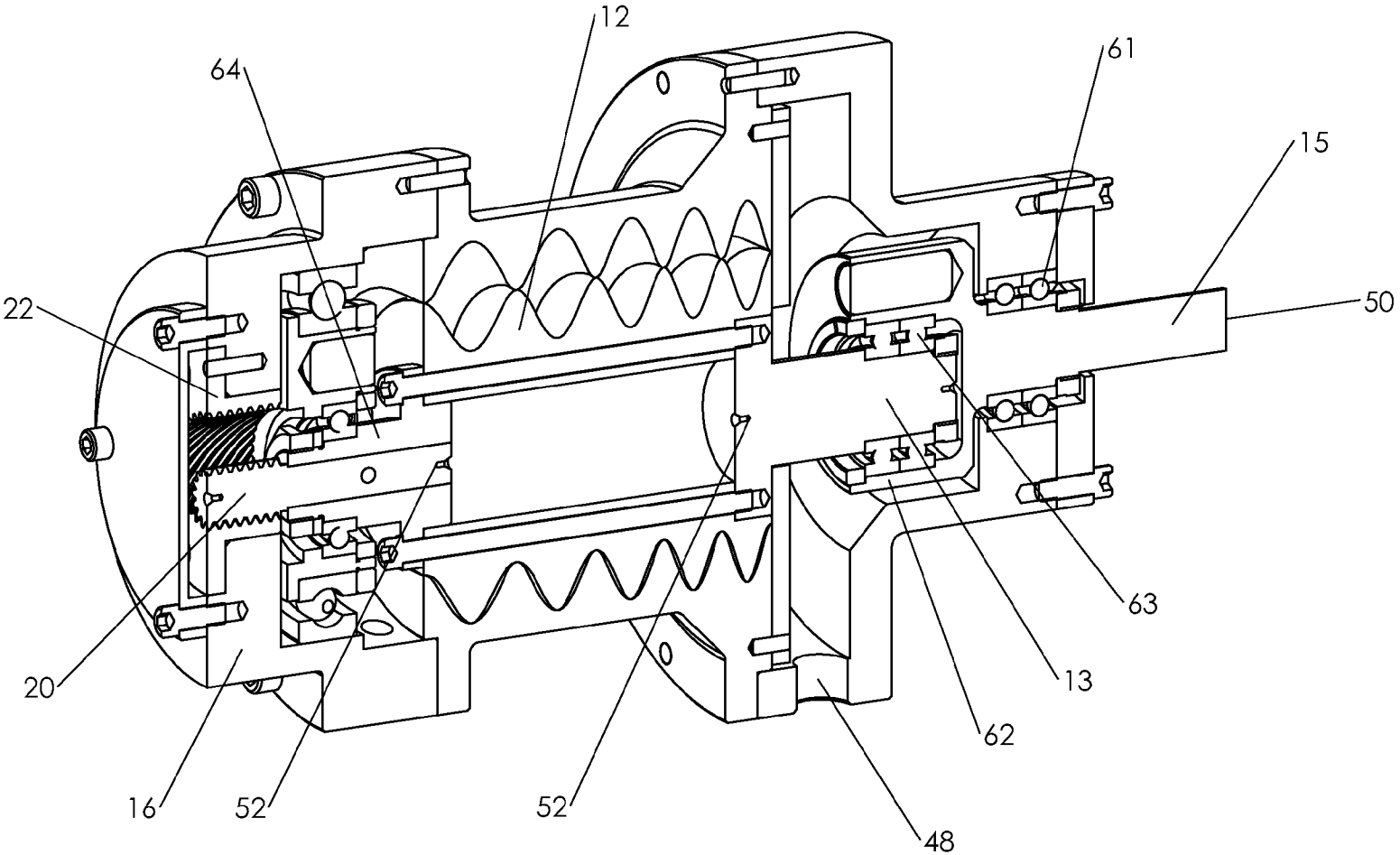
FIG. 10 is an isometric view of the varying-pitch compressor shown in longitudinal cross-section.

FIG. 10 shows details of the rotor mounting and drive mechanism. The compressor is shown driven from its outlet end by an electric drive motor 53 (indicated in FIG. 3) through a crankshaft 15, which is supported on crankshaft bearings 61. Crankshaft 15 terminates in a crankshaft cup 62, which contains internal cup bearings 63. The rotor shaft 13 is mounted inside the cup bearings 63. The rotor shaft center 52 is therefore defined by the common center of the crankshaft cup 62 and the cup bearings 63. The radial distance between the rotor shaft center 52 and the crankshaft center 50 is the previously mentioned axes separation, SEP.

The electric drive motor 53 rotates the crankshaft 15 in a counterclockwise direction (as viewed from the working-section inlet). Likewise, the crankshaft cup 62 moves the rotor shaft 13 in a counterclockwise orbit about the crankshaft center 50. In addition, while orbiting, the rotor shaft 13 rotates clockwise about its own axis, the rotor shaft center 52.

A rotor extension shaft 64 extends from the inlet end of the compressor, concentric with rotor shaft center 52. The required orbital motion of the rotor 12 is enabled at the inlet end of the compressor by planetary gearing. A stationary ring gear 22 is mounted in the inlet housing 16. Planetary gear 20 is mounted on the rotor extension shaft 64. Planetary gear 20 is carried by ring gear 22. When the crankshaft 15 is turned by the electric motor 53, the planetary gear 20 orbits inside the ring gear 22, and carries the rotor extension shaft 64 in its required orbital motion.

Sample Dimensions of Varying-Pitch Compressor

Following are the major dimensions of a sample embodiment of the varying-pitch compressor:

Radius of rotor disk (at each rotor cross-section), $R_r$=42.10 mm

Offset of rotor shaft center (at each rotor cross-section) from rotor rotation axis=8.42 mm (=SEP)

Rotor pitch for the entire 120 mm of stator length varies, as described in Table 1 below.

TABLE 1

| Rotor twist, N | | Downstream | Rotor pitch, dZ/dN | |
|---|---|---|---|---|
| Degrees | Turns | distance, Z(N) mm | mm/deg | mm/turn |
| 0 | 0.00 | 0.000 | 0.1124 | 40.475 |
| 90 | 0.25 | 9.832 | 0.1061 | 38.203 |
| 180 | 0.50 | 19.112 | 0.1002 | 36.059 |
| 270 | 0.75 | 27.871 | 0.0945 | 34.035 |
| 360 | 1.00 | 36.139 | 0.0892 | 32.125 |
| 450 | 1.25 | 43.943 | 0.0842 | 30.322 |
| 540 | 1.50 | 51.308 | 0.0795 | 28.620 |
| 630 | 1.75 | 58.261 | 0.0750 | 27.014 |
| 720 | 2.00 | 64.823 | 0.0708 | 25.497 |
| 810 | 2.25 | 71.016 | 0.0669 | 24.066 |
| 900 | 2.50 | 76.862 | 0.0631 | 22.716 |
| 990 | 2.75 | 82.380 | 0.0596 | 21.441 |
| 1080 | 3.00 | 87.589 | 0.0562 | 20.237 |
| 1170 | 3.25 | 92.505 | 0.0531 | 19.102 |
| 1260 | 3.50 | 97.145 | 0.0501 | 18.029 |
| 1350 | 3.75 | 101.524 | 0.0473 | 17.018 |
| 1440 | 4.00 | 105.658 | 0.0446 | 16.062 |
| 1530 | 4.25 | 109.560 | 0.0421 | 15.161 |
| 1620 | 4.50 | 113.243 | 0.0398 | 14.310 |
| 1710 | 4.75 | 116.719 | 0.0375 | 13.507 |
| 1800 | 5.00 | 120.000 | 0.0354 | 12.749 |

Following are major dimensions of the varying-pitch stator, in the preferred varying-pitch embodiment of the invention, based on a rotor-to-stator clearance of 0.075 mm:

Stator end semicircle radius, $R_s$=42.17 mm (=5*SEP)

Stator rectangular midsection width: =33.68 mm (=4*SEP)

Stator rectangular midsection height: =84.35 mm (=2*$R_s$)

Stator pitch for the entire 120 mm of stator length varies, as described in Table 1.

Table 1 shows the variation of downstream distance Z (mm) versus N, the number of turns of rotor twist angle. One rotor turn is 2π radians or 360 degrees. Values of Z are shown from Z=0 at the rotor inlet to Z=120 mm at the rotor outlet. The local rotor pitch, dZ/dN, is given in mm per turn. The rotor makes a total of 5 turns from inlet to outlet. The stator makes 2.5 turns from inlet to outlet. At each point in the working section, the local stator pitch is twice the local rotor pitch.

Local rotor pitch (dZ/dN) and number of turns (N) are related by the following differential equation:

$$dZ(N)/dN=C^*\exp(-qN) \quad (1)$$

where C and q are constants to be evaluated.

Equation (1) was selected to define the rotor twist because of its simplicity, and also because it results in cavity shapes that are invariant, except for a rescaling of the Z coordinate. Equation (1) integrates to give:

$$Z(N)=(C/q)^*[1-\exp(-qN)]=(C/q)^*(1-1/R\hat{}N), \text{ where } R=\exp(q); \text{ so } q=\ln(R) \quad (2)$$

Each cavity is two spacings long, so a cavity whose aft end is at Z(N) has its forward end at Z(N+2).

Therefore, the cavity length is $$L(N)=Z(N+2)-Z(N)=(C/q)^*[(1/R\hat{}N)-(1/R\hat{}(N+2))] \quad (3)$$

$$=(C/q)^*[1-1/R\hat{}2]/R\hat{}N \quad (4)$$

Therefore, moving a cavity forward by K spacings reduces its length and volume by a factor $$L(N)/L(N+K)=R\hat{}K \quad (5)$$

The first possible position for a closed cavity extends from Z(0) to Z(2), and its last possible position extends from Z(3) to Z(5). This is a displacement of three spacings, so the ratio of the initial and final lengths (and corresponding volumes) for a closed cavity is R^3. But the desired overall in-cavity compression ratio is 2. Therefore R=2^(1/3), and q=ln R=(ln 2)/3.

The constant ratio (C/q) may be evaluated from the boundary condition that N=5 at Z=120 mm, the working section outlet. Substitution into equation (2) gives:

$$120=(C/q)^*(1-R\hat{}(-5))=(C/q)^*(1-2\hat{}(-5/3)) \quad (6)$$

$$\text{from which } (C/q)=120/(1-2\hat{}(-5/3))=175.177 \quad (7)$$

With the above constants known. The values for Z and dZ/dN are computed directly from equations (1) and (2).

Description of Fixed-Pitch ("Baseline") Compressor with Valves

Figure 11:
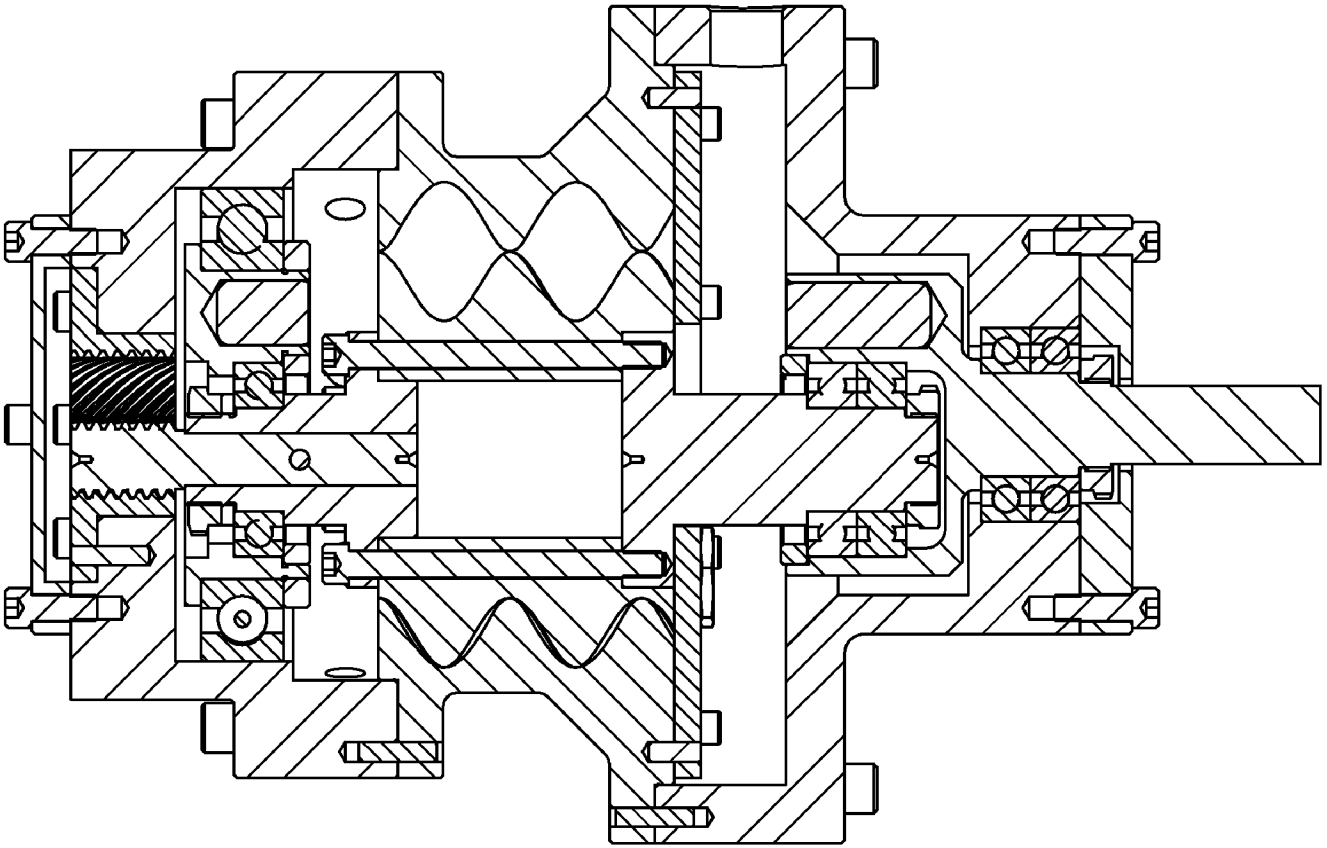

This section describes a fixed-pitch unit as shown in FIG. 11.

The basic Moineau pump geometry, with a fixed-pitch working section, can be adapted to function as a compressor, raising the pressure of a compressible gas. In concept, this configuration can be created by altering the outlet end of a Moineau fixed-pitch progressive cavity pump, adding an endplate with outlet ports. A check valve or valves must also be added at the outlet end, to permit the pressure in the outlet cavities to build up to equal or slightly exceed the required outlet pressure.

The fixed-pitch working section does no compression except at the discharge end, where the cavity volume decreases as the gas is compressed against a fixed endplate and expelled through the outlet ports and valves. For a cavity in contact with the compressor discharge port, the pressure of the gas in the cavity will be below the compressor discharge pressure until the cavity volume has decreased enough to compress the gas in the cavity to the discharge pressure level. As in the varying-pitch unit, check valves are essential to prevent backflow through a discharge port into the adjacent cavity while the gas in the cavity is being compressed up to discharge pressure. When the gas pressure in the cavity has risen slightly above discharge pressure, the check valve opens, and the gas flows out at nearly constant pressure until the cavity is almost completely emptied. Then the check valve closes to prevent backflow into the next-following cavity, and the cycle repeats.

Sample Dimensions of Fixed-Pitched Compressor

Following are major dimensions of a sample embodiment of the fixed-pitch unit. All cross-sectional dimensions of the fixed-pitch unit are the same as the corresponding dimensions of the varying-pitch unit:

Rotor disk radius (at each rotor cross-section) $R_r$=42.10 mm

Offset of rotor shaft center from rotor rotation axis (at each rotor cross-section)=8.42 mm (=SEP).

Stator end semicircle radius, $R_s$=42.17 mm

Stator rectangular midsection width: =33.68 mm (=4*SEP)

Stator rectangular midsection height: =84.35 mm (=2*$R_s$)

The fixed-pitch working section is much shorter than the varying-pitch unit:

Length of fixed-pitch working section=72 mm

Length of varying-pitch working section=120 mm

The fixed-pitch unit has only 2.25 rotor turns versus 5 turns for the varying-pitch unit. The fixed-pitch unit needs only a fraction of a turn in the mid-section, which is closed to both the inlet and outlet ports during part of each crank-arm rotation, because the fixed-pitch unit does no compression in the mid-section. Mid-section length is a tradeoff between leakage and cost in a fixed-pitch unit. A long mid-section would cut leakage and add to cost.

With 2.25 rotor turns in 72 mm, the length of a single rotor turn is 72/2.25=32 mm. This is the rotor pitch, 32 mm/turn.

This fixed-pitch design with valves will be used in the next section as a baseline against which the varying-pitch preferred embodiment is evaluated.

Evaluation of the Varying-Pitch vs. the Fixed-Pitch Embodiments

The baseline for evaluation and comparison of the preferred embodiment is the fixed-pitch progressive cavity compressor with valves.

This baseline (which could also be described as an "endplate/check valve compressor") is capable in principle of efficient operation for a range of outlet pressures, but it imposes severe requirements on the check valves and the flow through them. The pressure drops through open valves must be low despite high flow rates during the relatively short times that the valves are open, and closing must be very quick to limit backflow. Current industrial compressor practice indicates that these valves work well at compressor speeds up to about 1800 rpm.

The preferred varying-pitch embodiment mitigates these problems by combining the check valve idea (compression against an endplate) with the idea of compression within the working section, before a cavity reaches the endplate. This eases the check valve performance problem in two ways:

(1) It creates a less demanding duty cycle, since the check valves are open for a larger fraction of each operation cycle. This reduces the required peak flow rates.

(2) Any backflow resulting from non-ideal functioning of check valves is into a cavity that is already partially compressed. Therefore, the pressure difference and the backflow are reduced. Quick-closing valve requirements are reduced.

The most important advantage of the preferred varying-pitch embodiment is the ability to handle a range of compressor pressure ratios with good efficiency. Consider a hot day air conditioning system design point, with desired room temperature of 75 F, and an outside ambient air temperature of 100 F. For these conditions, the following refrigerant temperatures are reasonable:

Refrigerant evaporating temperature: 40 F

Refrigerant superheat: 10 F

Compressor inlet temperature: 50 F

Refrigerant condensing temperature: 120 F

For these conditions, the required compression ratio, $CR_2$, is about 3.0, with a standard vapor cycle refrigerant.

The fixed-pitch compressor can be designed for the above conditions. But check valve function may limit performance.

The preferred embodiment (with varying-pitch rotor and stator) promotes the effective design point functioning of the check valves by providing the check valves higher input pressures than would be available in the fixed-pitch design. The varying-pitch working section is designed to give an internal compression ratio $CR_1$ of about 2. This leaves a compression ratio of only 3/2=1.5 to be performed by compression against the endplate, in the open-to-outlet part of the working section, at the design point. The result is improved check valve performance and lower losses than in the fixed-pitch design.

At lower ambient temperatures, as the required compression ratio falls, the check valves stay open for an increased portion of the compressor cycle. At some reduced ambient temperature, the check valves stay open for the entire cycle.

For higher ambient temperatures, the required compression against the endplate increases, but is always much less than the compression ratio that the fixed-pitch design would require.

With the reduced compression required from the endplate, when a vented cavity discharges its fluid and the valve must close, the succeeding cavity in the same lobe (served by the same check valve) is already close to the required pressure. This reduces the back-flow velocity (and associated energy loss) and therefore reduces the need for a fast-closing valve. This advantage is most effective for low ambient temperatures, but gives some benefit at any ambient temperature below the design maximum.

Alternative Embodiments for In-Cavity (Varying-Pitch) Compression

The preferred embodiment is the varying-pitch progressive cavity compressor with valves. This section further discusses in-cavity compression. In addition to the varying-pitch method already introduced, we discuss two further methods: conical geometry, and parallel curves.

These three techniques can be used, singly or in combination, to make cavities decrease in volume as they move through the working section—and thereby convert a progressive cavity pump into a progressive cavity compressor, or convert an endplate/check valve compressor into a hybrid compressor. All three techniques are mentioned in Moineau, U.S. Pat. No. 1,892,217.

As is well known, there are two principal types of progressive cavity pumps. In one type, the fluid occupies spaces (cavities) between the outer surface of an inner rotor, and the inner surface of an outer rotor. Both rotors have fixed axes.

In the second type of progressive cavity pump, the outer rotor is replaced by a stator. The rotor turns about a moving axis that is parallel to the symmetry axis of the stator, and has a constant distance from it.

The discussion below is restricted to progressive cavity machines of the second type (with rotor and stator). The reason for this restriction is that the endplate/check valve concept is not readily applicable to a compressor that has no stator (and hence no convenient place to put the valves). It is further restricted by assuming (as in the preferred embodiment) that the rotor and stator cross-sectional curves have one and two lobes, respectively. Designs with more lobes (and therefore more check valves) are possible, but are not examined in this discussion.

A progressive cavity pump having the specified restrictions can be converted into a corresponding progressive cavity compressor by changing its geometry so that the cavities decrease in volume as they move through the working section. This can be done in several ways, as discussed below. The resulting compressors have a fixed ratio of volumetric compression, determined by the ratio of a cavity's volume at capture (when it gets sealed off from the intake plenum) to its volume at venting (when its forward end emerges from the working section).

Similarly, a progressive cavity compressor that has a one-lobe rotor, a two-lobe stator, and a fixed compression ratio can be converted into a hybrid compressor with a variable compression ratio by adding an endplate, and two outlet ports fitted with check valves.

Varying-Pitch

For a progressive cavity pump, or the baseline fixed-pitch compressor, the rotor and stator surfaces are helical: all the cross-sectional curves of each surface are identical in size and shape, differing only by a twist-rotation about a Z axis, and translation along it. The translation is related to the twist rotation by a constant factor called the helical pitch:

$$\text{Helical pitch}=dZ/d\theta$$

where θ is a twist angle. There is a constant ratio between the twist-angles of rotor and stator curves at the same Z. For the Moineau geometry with one rotor lobe and two stator lobes this ratio is $\theta_r/\theta_s=2$. Therefore, the helical pitches of these two surfaces also differ by a factor of 2.

A simple way to make cavities shrink as they move through the working section is to replace the linear relation between Z and the twist angles by a nonlinear one.

It is convenient to regard $\theta_r$ as the independent variable, and set $\theta_s=\theta_r/2$ and $Z=F(\theta_r)$ where F is a chosen function. Then $F'(\theta_r)$ is the helical pitch of the rotor surface. If $F'(\theta_r)$ decreases as $\theta_r$ increases, the fluid will be compressed.

The volumetric compression ratio for a cavity moving through the working section is the ratio of its initial volume (just after capture) to its final volume (just before venting).

This compression ratio will be smaller than the ratio of the values of $F(\theta_r)$ at the two ends of the working section, because of an effective averaging over the length of a cavity.

There is considerable freedom in choosing the function $F(\theta_r)$. One convenient choice, which leads to relatively simple calculations, is an exponential function:

$$F(\theta_r)=K_0*\exp(-K_1*\theta_r)$$

where $K_0$ and $K_1$ are chosen constants. However, there are possible reasons for choosing a more complicated equation, with more coefficients. Making $F(\theta_r)$ change more slowly near the inlet of the working section delays the compression, and therefore reduces leak-back to the inlet plenum. Making it change more slowly near the outlet end reduces the back-flow through a closing valve, and may also reduce manufacturing problems associated with cramped spacings between successive turns of the helix.

Conical Geometry

A well-known alternative method of making cavities shrink as they move through the working section is to replace the cylindrical geometry (with parallel axes for rotor and stator) by a conical geometry (with axes converging toward a point outside the working section). All transverse dimensions shrink as they approach this convergence point, so cross-sectional areas shrink as the square of this distance from this convergence point.

The volumetric compression ratio will be smaller than the ratio of initial and final areas, because of averaging over the length of a cavity.

If the required ratio of initial and final transverse dimensions to attain a specified compression ratio is inconveniently large, this problem can be mitigated by using a conical geometry in combination with varying-pitch.

A longitudinal cross-section of the rotor or stator shows a succession of maxima and minima of radial distance from the axis. Varying-pitch reduces the spacing between successive maxima or minima, but conical geometry reduces the amplitude of the variations. This makes it possible to avoid a possible machining problem stemming from an excessive ratio of depth to longitudinal spacing.

Parallel Curves

For any given pair of cross-sectional curves for the rotor and stator, a pair of curves "parallel" to the original curves can be generated by moving all points outward or inward (orthogonal to the local tangent) by some chosen distance D. The resulting pair of curves works equally well, but alters the fluid area in a cross-section.

For the Moineau case, where each rotor cross-section is a circle, this change replaces the constant circle-radius with a variable radius. The radii of the semi-circular arcs of the stator cross-section curves are changed accordingly.

This change is not a very useful technique for decreasing the cavity volume if used by itself, since decreasing the circle-radius has undesirable side-effects. But when used in combination with the other two techniques, it gives an extra degree of design freedom.

Increasing these circle radii near the high-pressure end of the working section sacrifices some of the volumetric compression that might otherwise occur, but it provides more room for outlet-ports, and for an enlargement (and therefore a strengthening) of the rotor-core that penetrates the endplate. Also, leakage past the endplate can be reduced.

The problems of fabrication and assembly for the hybrid compressor are not significantly different from those for the baseline endplate/check valve compressor. The mathematical definitions of the rotor and stator surfaces of the hybrid design are more complex, but this is not a significant disadvantage if these surfaces are created by numerical control of the cutting tools.

Endplate Geometry

The analysis in this section applies to both the varying-pitch and fixed-pitch embodiments. An essential feature of the compressor design is an endplate at the high-pressure end of the working section. This endplate is pierced with three holes: two outlet ports for check valves, and a central hole that allows an extension of the rotor to connect to a drive mechanism on the other side of the endplate.

This central hole must be large enough to accommodate the rotor extension and its planetary motion around the stator axis, but small enough so that flow through the hole is blocked (except for a small leakage) by the high-pressure end of the working section of the rotor. To keep the leakage small, the rotor must cover the hole in the endplate during the entire cycle of rotor motion.

In the varying-pitch and fixed-pitch embodiments described above and shown in FIGS. 1-11, the rotor extension has a circular cross-section, centered about the rotor axis. The rotor extension is also referred to as a rotor shaft. The central hole in the endplate is a circle centered about the stator axis.

Endplate leakage can be reduced by shrinking the central hole, but this necessitates shrinking the diameter of the rotor shaft, which reduces the rigidity of the rotor. Therefore, there is a trade-off between leakage and rigidity.

A more favorable trade-off is achievable by using a non-circular hole, penetrated by a rotor extension that may be off-center and/or non-circular until it is clear of the endplate, and then reverts to a centered, circular form.

For convenience in what follows, the axes separation SEP is chosen as the unit of length, so all other parameters of the cross-sectional geometry become pure numbers. In particular, the radius of a rotor cross-section circle is P (currently=5, for both the varying-pitch and fixed-pitch embodiments).

For a case where the cross-section of the rotor extension is circular and centered around the rotor axis, let $R_s$ and $R_h$ denote the radii of the rotor shaft and the central endplate hole respectively. Since the orbital motion of the rotor axis is a circle of unit radius, it is necessary that $$R_s=R_h-1-\text{clearance} \quad (1)$$

where "clearance" is a small number necessary to prevent radial contact between the orbiting rotor shaft and the hole in the endplate. Let us consider the final cross-section of the working section, next to the endplate. The final cross-sectional curve for the stator consists of two semi-circles of radius P, with centers 4 units apart, with a connecting rectangle of dimensions 4*2P in between. Let X and Y coordinates in this final cross-section be chosen so the coordinates of the centers of these semicircles are (2,0) and (−2,0).

The combined orbital and spin rotations of the rotor cause its final cross-sectional curve to move sinusoidally along the X axis, between two extreme positions, which correspond to the semicircles of the stator curve. The two dotted circles in FIG. 12 show these extreme positions of the rotor disc.

Figure 12:
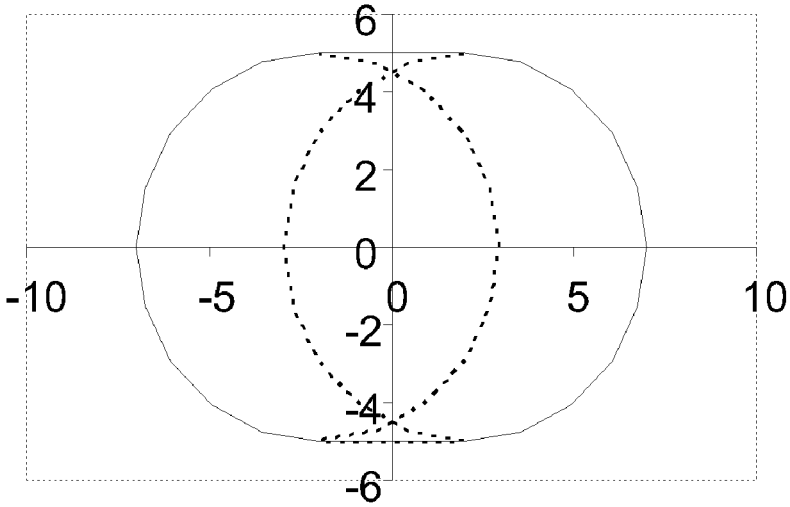
FIG. 12 graphically depicts a generally lens-shaped maximal region for a hole that pierces the outlet endplate.

An obvious necessary condition for flow blockage to occur for all possible positions of the rotor is that the central hole in the endplate be entirely within the intersection of the two rotor-circles in FIG. 12. But this is a "just barely" condition. To make the endplate leakage reasonably low, there must be some finite overlap distance $D_o$, so the limiting radii of the two circular arcs in FIG. 12 must be reduced to a value $P_o$, where $$P_o=P-D_o \quad (2)$$

Figure 13:
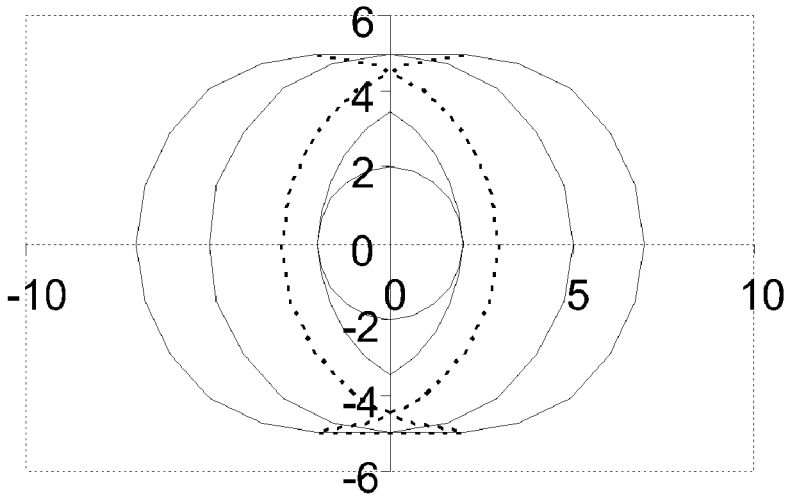
FIG. 13 graphically depicts a reduced size "allowed region" with a specified overlap-margin, and the largest circular hole that can fit within it.

For any chosen value of $D_o$, this gives reduced limits for the maximum allowable extent of the central hole. FIG. 13 shows these limits for an example-case with $D_o=1$.

If the central hole is circular, its maximum allowable radius is $$R_h=P_o-2=P-2-D_o \quad (3)$$

and the maximum allowable radius for the rotor shaft is $$R_s=P-3-D_o-\text{clearance} \quad (4)$$

For the simple design with circular hole and circular extension, P=5, so (4) gives $$R_s=2-D_o-\text{clearance} \quad (5)$$

This implies a tradeoff between $D_o$ and $R_s$: increasing the overlap $D_o$ to reduce leakage will decrease $R_s$, compromising the rigidity of the rotor. Choosing $D_o=1$ (as in FIG. 13) gives $$R_s=1-\text{clearance} \quad (6)$$

Figure 14:
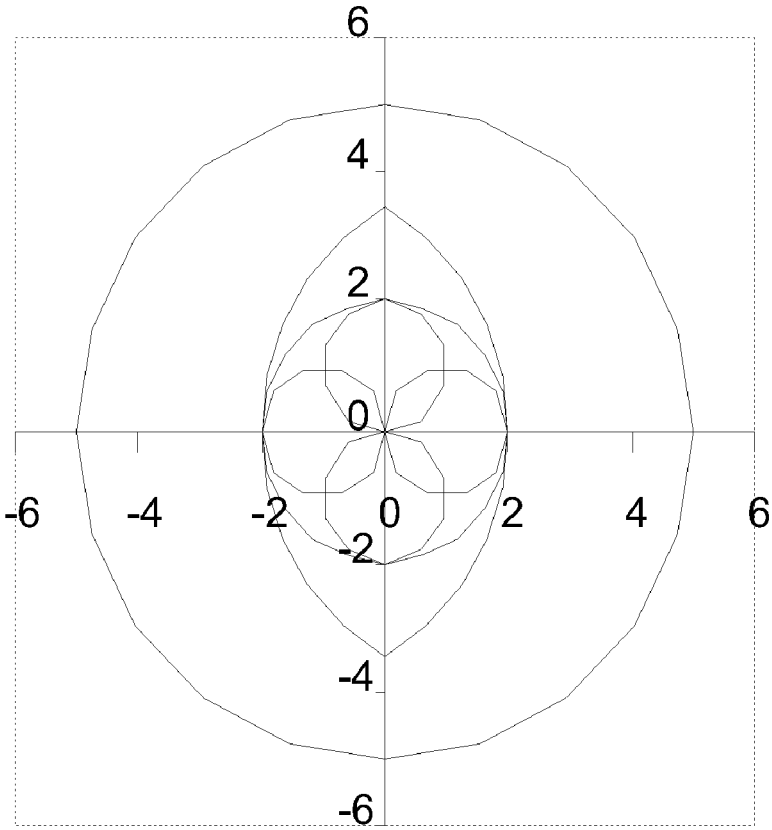
FIG. 14 shows four positions of a rotor shaft (circular extension) that orbits within a circular hole.

FIG. 14 shows a circular hole that fits within the allowed region, and four possible positions of a rotor shaft within that hole, corresponding to four different crank angles, 90 degrees apart. Two of these crank angles correspond to the extreme positions of the rotor shown in FIGS. 12 and 13, and the other two correspond to the central position.

A better tradeoff is possible if the cross-section of the rotor extension through the endplate is not required to be circular, and need not be centered around the rotor axis.

Instead, let it be as large as possible, subject to a requirement that for all possible rotor positions, the cross-section of the rotor extension fit within the inner lens-shaped region shown in FIGS. 13 and 14.

This lens-shaped region is defined on the stator, but for any given rotor-position it can be mapped onto the rotor cross-section, giving curves which restrict the rotor extension.

Figure 15:
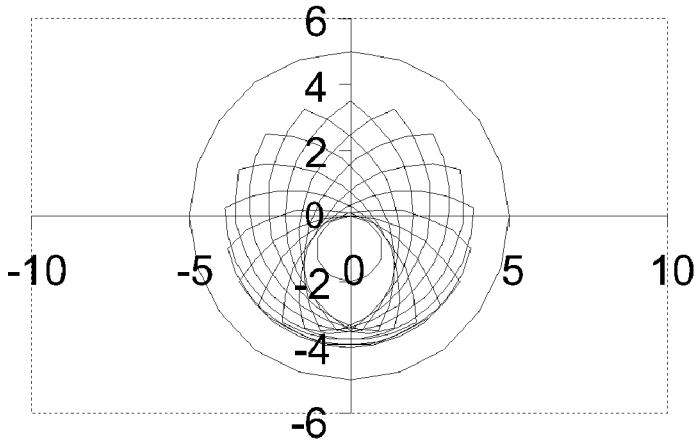
FIG. 15 shows an envelope of hole-boundaries which defines a non-circular, maximal cross-section for a rotor extension, with a maximal rotor shaft (circular extension) shown for comparison.

FIG. 15 shows the restrictions implied by a set of rotor positions, corresponding to crank angles 30 degrees apart. Considering all possible positions (instead of a finite set) defines the maximum allowed cross-section of the rotor extension as the inner envelope of a family of lens-shaped curves.

For comparison, FIG. 15 also shows a small circle, representing the cross-section of a rotor extension that is required to be circular and centered around the rotor axis.

The improved rigidity made possible by allowing a non-circular cross-section for the rotor extension is not just proportional to the cross-sectional area; it varies as the second moment. But, to be conservative, one should consider the second moment in the least favorable direction.

Figure 16:
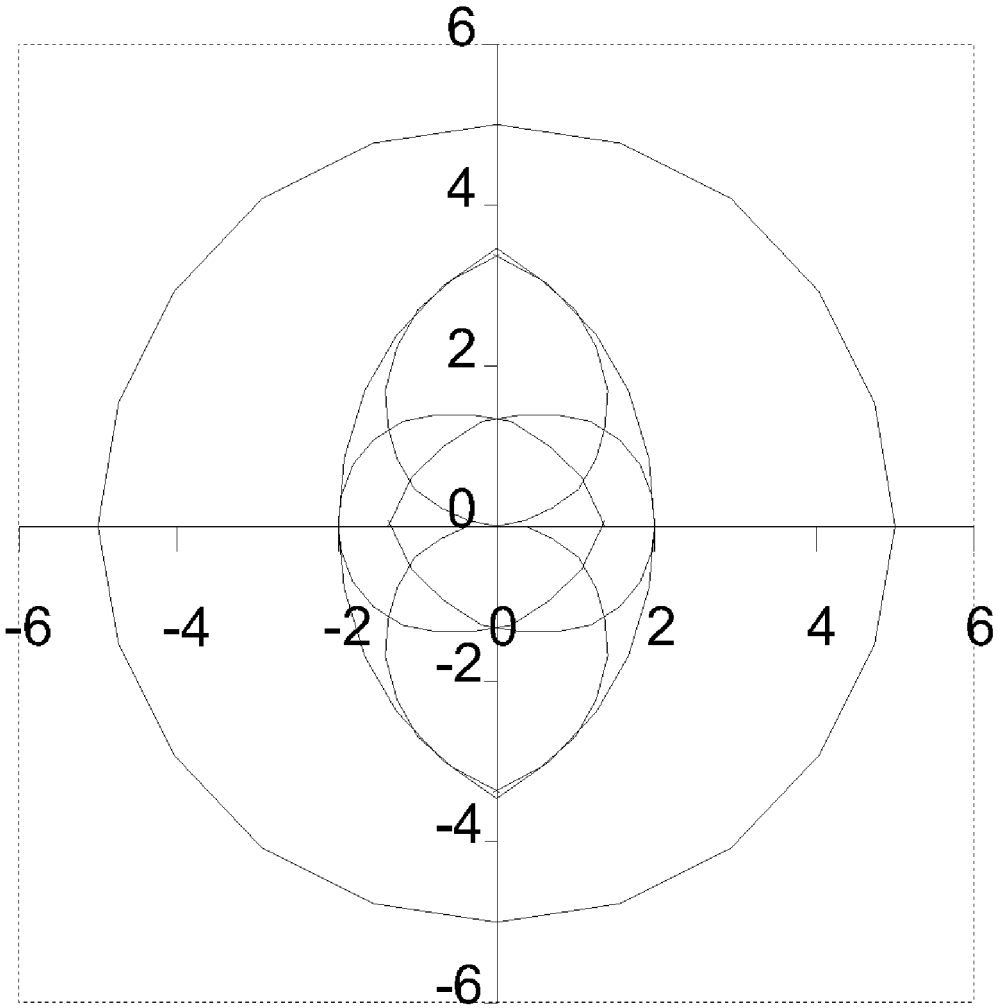
FIG. 16 shows four positions of a maximal, non-circular rotor extension that orbits within a non-circular hole.

FIG. 16 shows four different positions of the rotor extension within the endplate hole, corresponding to crank angles of 0, 90, 180 and 270 degrees.

Air Conditioning System

Figure 17:
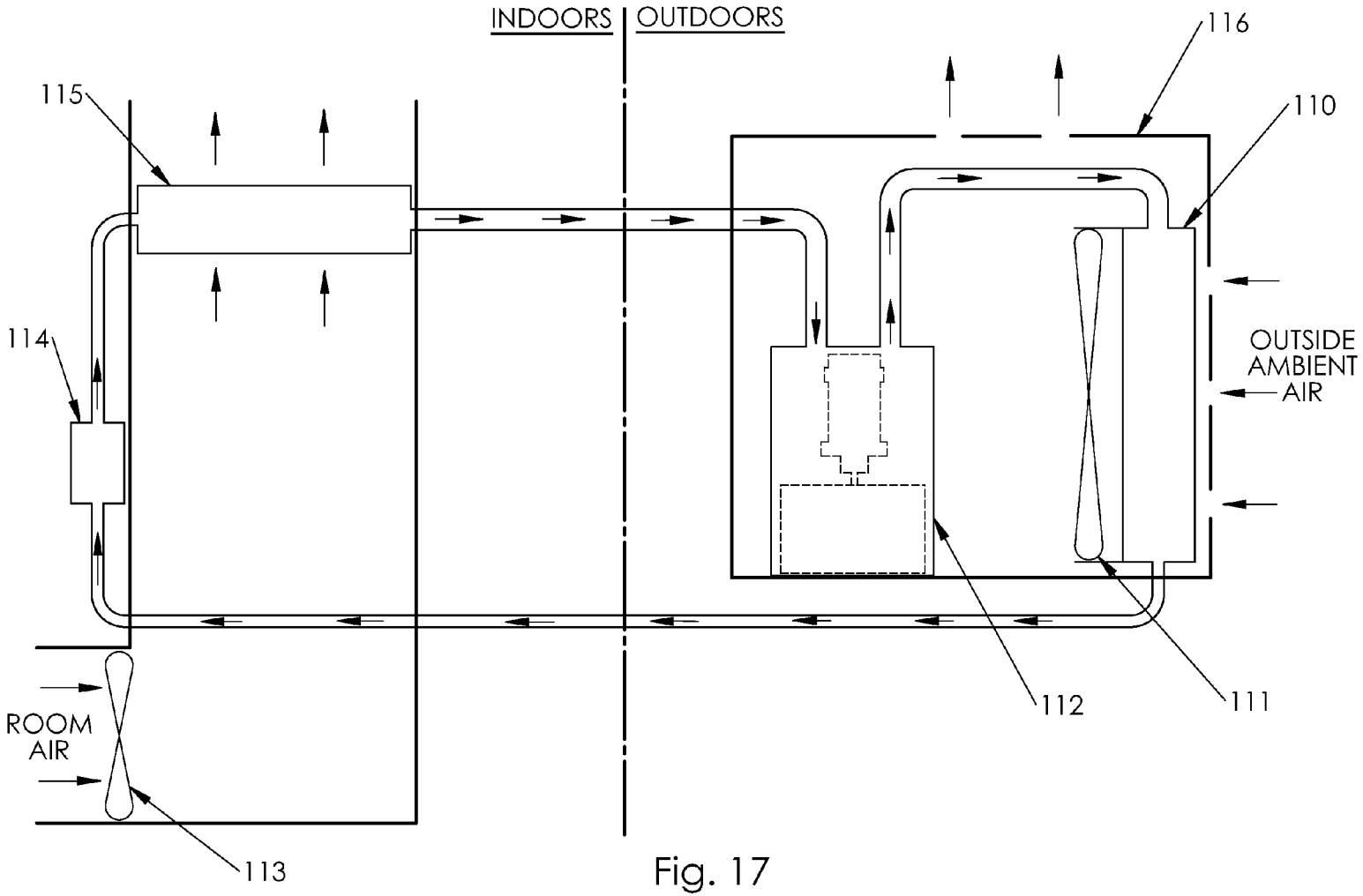
FIG. 17 is a block diagram showing the compressor of the present invention incorporated into an air conditioning system.

FIG. 17 illustrates a compressor 112 constructed according to the invention as described in detail above and as shown in FIGS. 1-16 incorporated into a closed-cycle air conditioning system for a residential or commercial building or the like. As shown, the compressor 112 provides gaseous refrigerant to a condenser 110 typically associated with a fan 111, wherein the compressor 112, condenser 110 and fan 111 are conventionally mounted within an outside or external condensing unit 116 of the air conditioning system. The condenser 110 (and fan 111) function to reduce the temperature of the refrigerant for appropriate conversion to a liquid state, wherein this now-liquid refrigerant is flow-coupled with an expansion device 114 such as an expansion valve or the like, and an evaporator or heat exchanger 115 within the building. Building air is normally circulated over the surfaces of the evaporator 115 by means of an interior fan 113 or the like, to chill the building air. The refrigerant is coupled in turn from the evaporator 115 back to an intake side of the compressor 112 for recompression and recirculation.

Although various embodiments and alternatives have been described in detail for purposes of illustration, various further modifications may be made without departing from the scope and spirit of the invention. Accordingly, no limitation on the invention is intended by way of the foregoing description and accompanying drawings, except as set forth in the appended claims.

What is claimed is:

1. A progressive cavity compressor for compressing a working fluid, comprising;

a compressor housing defining a stator having a generally helical working section defining at least two lobes and extending between an inlet end and an outlet end, said helical working section having a cross sectional shape at each axial position between said inlet and outlet ends defined by a plurality of generally semi-circular ends corresponding in number with the number of said at least two stator lobes;

a rotor having a generally helical shape mounted within said stator, said at least two stator lobes exceeding the number of lobes of said rotor by one;

means for rotatably driving said rotor in a first rotational direction about an axis of said rotor, and for orbitally driving said rotor in a second rotational direction within said stator in close running clearance therewith;

a discharge end plate mounted generally at said outlet end of said compressor housing and defining at least a portion of an outlet plenum chamber; and a plurality of check valves carried in a symmetric array by said discharge end plate, said plurality of check valves corresponding in number with the number of stator lobes;

said rotor and said stator cooperatively drawing in the working fluid at said inlet end of said compressor housing upon rotatable and orbital driving of said rotor, cooperatively defining at least one moving cavity therebetween for displacing the working fluid from said inlet end to said outlet end, and discharging the working fluid through said plurality of check valves into said outlet plenum chamber.

2. The progressive cavity compressor of claim 1 wherein the working fluid comprises a compressible refrigerant.

3. The progressive cavity compressor of claim 1 wherein said at least one moving cavity has a varying size decreasing over at least a portion of the distance from said inlet end to said outlet end.

4. The progressive cavity compressor of claim 3 wherein said at least one moving cavity decreases in size progressively from said inlet end to said outlet end.

5. The progressive cavity compressor of claim 1 wherein said rotor and said stator cooperatively define a decreasing pitch over at least a portion of the distance from said inlet end to said outlet end.

6. The progressive cavity compressor of claim 5 wherein said rotor and said stator cooperatively define a progressively decreasing pitch from said inlet end to said outlet end.

7. The progressive cavity compressor of claim 1 wherein said stator has a cross sectional shape defining a pair of lobes having a pair of generally semi-circular ends of diameter D separated by a rectangle having linear dimension H extending between opposed ends of said pair of generally semi-circular ends, and further wherein the linear dimension H is equal to four times the separation between an axis of rotor rotation in said first direction, and an axis of rotor orbital movement in said second direction.

8. The progressive cavity compressor of claim 1 wherein said means for rotatably and orbitally driving said rotor comprises a rotatably driven crankshaft coaxial with said stator and rotatably driving a crankshaft cup, said rotor having a rotor shaft rotatably driven by said crankshaft cup in said first rotational direction about said rotor axis, and orbitally driven about an axis of said crankshaft in said second rotational direction.

9. The progressive cavity compressor of claim 8 wherein said means for rotatably and orbitally driving said rotor comprises said crankshaft cup disposed at one end of said rotor shaft, a stationary ring gear disposed at an opposite end of said rotor shaft, and a planetary gear carried by said rotor shaft generally at said opposite end for engaging said ring gear.

10. A progressive cavity compressor for compressing a working fluid, comprising;

a compressor housing having a stator with at least two lobes defining a generally helical working section extending between an inlet end and an outlet end, said helical working section having a cross sectional shape at each axial position between said inlet and outlet ends defining a plurality of generally semi-circular ends corresponding in number with the number of said at least two stator lobes;

a rotor having a generally helical shape mounted within said stator, said at least two stator lobes exceeding the number of lobes of said rotor by one;

means for rotatably driving said rotor in a first rotational direction about an axis of said rotor, and for orbitally driving said rotor in a second rotational direction within said stator in close running clearance therewith;

a discharge end plate mounted generally at said outlet end of said compressor housing and defining at least a portion of an outlet plenum chamber; and a plurality of check valves carried in a symmetric array by said discharge end plate, said plurality of check valves corresponding in number with the number of stator lobes;

said rotor and said stator cooperatively defining a progressively decreasing pitch from said inlet end to said outlet end;

said rotor and said stator cooperatively drawing in the working fluid at said inlet end of said compressor housing upon rotatable and orbital driving of said rotor, cooperatively defining at least one moving cavity therebetween for at least partially compressing the working fluid from said inlet end to said outlet end, and discharging the working fluid through said plurality of check valves into said outlet plenum chamber.

11. The progressive cavity compressor of claim 10 wherein the working fluid comprises a compressible refrigerant.

12. The progressive cavity compressor of claim 10 wherein said stator has a cross sectional shape defining a pair of lobes having a pair of generally semi-circular ends of diameter D separated by a rectangle having linear dimension H extending between opposed ends of said pair of generally semi-circular ends, and further wherein the linear dimension H is equal to four times the separation between an axis of rotor rotation in said first direction, and an axis of rotor orbital movement in said second direction.

13. The progressive cavity compressor of claim 10 wherein said means for rotatably and orbitally driving said rotor comprises a rotatably driven crankshaft coaxial with said stator and rotatably driving a crankshaft cup, said rotor having a rotor shaft rotatably driven by said crankshaft cup in said first rotational direction about said rotor axis, and orbitally driven about an axis of said crankshaft in said second rotational direction.

14. The progressive cavity compressor of claim 13 wherein said means for rotatably and orbitally driving said rotor comprises said crankshaft cup disposed at one end of said rotor shaft, a stationary ring gear disposed at an opposite end of said rotor shaft, and a planetary gear carried by said rotor shaft generally at said opposite end for engaging said ring gear.

15. A method of compressing a working fluid to a variable compression ratio, comprising the steps of:

drawing the working fluid into an inlet end of a progressive cavity compressor having:

a stator having at least two lobes defining a generally helical working section extending between an inlet end and an outlet end, said helical working section having a cross sectional shape at each axial position between said inlet and outlet ends defined by a plurality of generally semi-circular ends corresponding in number with the number of said at least two stator lobes;

a rotor having a generally helical shape mounted within said stator, said at least two stator lobes exceeding the number of lobes of said rotor by one, a discharge end plate mounted generally at an outlet end of said rotary compressor and defining at least a portion of an outlet plenum chamber, a plurality of check valves carried in a symmetric array by said discharge end plate, said plurality of check valves corresponding in number with the number of stator lobes, and means for rotatably driving said rotor in a first rotational direction about an axis of said rotor, and means for orbitally driving said rotor in a second rotational direction within said stator in close running clearance therewith;

said rotor and said stator cooperatively drawing in the working fluid at said inlet end upon rotatable and orbital driving of said rotor, cooperatively defining at least one moving cavity therebetween for at least partially compressing the working fluid from said inlet end to said outlet end, and discharging the working fluid through said plurality of check valves into said outlet plenum chamber;

whereby the working fluid is at least partially compressed to a first pressure level within said moving cavity and is further compressible to a second, higher pressure level for passage through said check valves into said outlet plenum chamber.

16. A progressive cavity compressor for variably compressing a working fluid, comprising:

means defining a compressor having an inlet end and an outlet end, and at least one moving cavity disposed between said inlet and outlet ends for partially compressing the working fluid to a first pressure level;

means defining an outlet plenum chamber; and at least one check valve disposed between said outlet end and said plenum chamber, whereby the working fluid is compressed within said at least one moving cavity to the first pressure level, and is further compressed to a second, higher pressure level by reduction of the volume of said moving cavity as it moves toward said outlet end;

said compressor defining means comprising a stator having at least two lobes defining a generally helical working section extending between said inlet end and said outlet end, said helical working section having a cross sectional shape at each axial position between said inlet and outlet ends defined by a plurality of generally semi-circular ends corresponding in number with the number of said at least two stator lobes, a rotor having a generally helical shape mounted within said stator, said at least two stator lobes exceeding the number of lobes of said rotor by one, a discharge end plate mounted generally at an outlet end of said rotary compressor and defining at least a portion of said outlet plenum chamber, said at least one check valve comprising a plurality of check valves carried in a symmetric array by said discharge end plate and corresponding in number with the number of stator lobes, and means for rotatably driving said rotor in a first rotational direction about an axis of said rotor, and for orbitally driving said rotor in a second rotational direction within said stator in close running clearance therewith, said rotor and said stator cooperatively drawing in the working fluid at said inlet end upon rotatable and orbital driving of said rotor, cooperatively defining said at least one moving cavity therebetween for at least partially compressing the working fluid from said inlet end to said outlet end, and discharging the working fluid through said plurality of check valves into said outlet plenum chamber;

said at least one check valve being responsive to the pressure differential between the moving cavity pressure and the outlet plenum chamber pressure, said at least one check valve opening when the moving cavity pressure exceeds the outlet plenum chamber pressure by a small amount.

17. In a closed loop air conditioning system having a compressor for supplying compressed refrigerant to a condenser, an expansion device for receiving refrigerant from said condenser, and an evaporator for receiving refrigerant from said expansion device, said refrigerant being recirculated from said evaporator to said compressor, the improvement comprising:

said compressor including a progressive cavity compressor housing defining a stator having a generally helical working section defining at least two lobes and extending between an inlet end and an outlet end, said helical working section having a cross sectional shape at each axial position between said inlet and outlet ends defined by a plurality of generally semi-circular ends corresponding in number with the number of said at least two stator lobes;

a rotor having a generally helical shape mounted within said stator, said at least two stator lobes exceeding the number of lobes of said rotor by one;

means for rotatably driving said rotor in a first rotational direction about an axis of said rotor, and for orbitally driving said rotor in a second rotational direction within said stator in close running clearance therewith;

a discharge end plate mounted generally at said outlet end of said compressor housing and defining at least a portion of an outlet plenum chamber; and a plurality of check valves carried in a symmetric array by said discharge end plate, said plurality of check valves corresponding in number with the number of stator lobes;

said rotor and said stator cooperatively drawing in refrigerant from the evaporator at said inlet end of said compressor housing upon rotatable and orbital driving of said rotor, cooperatively defining at least one moving cavity therebetween for displacing the refrigerant from said inlet end to said outlet end, and discharging the refrigerant through said plurality of check valves into said outlet plenum chamber and further to the condenser.

* * * * *